US008482497B2

(12) United States Patent
Zhang et al.

(10) Patent No.: US 8,482,497 B2
(45) Date of Patent: Jul. 9, 2013

(54) SWITCH MATRIX AND DISPLAY MATRIX OF DISPLAY DEVICE

(75) Inventors: Lei Zhang, Jiangsu Province (CN); Herb He Huang, Jiangsu Province (CN)

(73) Assignee: Jiangsu Lexvu Electronics Co., Ltd., Zhenjiang, Jiangsu Province (CN)

( * ) Notice: Subject to any disclaimer, the term of this patent is extended or adjusted under 35 U.S.C. 154(b) by 475 days.

(21) Appl. No.: 12/815,118

(22) Filed: Jun. 14, 2010

(65) Prior Publication Data

US 2011/0037684 A1 Feb. 17, 2011

(30) Foreign Application Priority Data

Aug. 11, 2009 (CN) ..... 2009 1 0164858

(51) Int. Cl.
*G09G 3/34* (2006.01)

(52) U.S. Cl.
USPC ..... 345/85; 345/84; 345/108; 345/204; 345/694; 257/414; 257/632; 359/198.1; 359/290

(58) Field of Classification Search
USPC ..... 313/498–506; 345/82–98, 102–109, 345/204–214, 690–698; 200/181; 257/414–467, 257/632–784, 88; 349/106–143, 43–98; 359/198.1–298
See application file for complete search history.

(56) References Cited

U.S. PATENT DOCUMENTS

| | | | | |
|---|---|---|---|---|
| 6,037,719 | A * | 3/2000 | Yap et al. | 315/169.3 |
| 6,392,618 | B1 * | 5/2002 | Kimura | 345/85 |
| 2004/0007970 | A1 * | 1/2004 | Ma et al. | 313/504 |
| 2004/0196215 | A1 * | 10/2004 | Duthaler et al. | 345/30 |
| 2004/0262653 | A1 * | 12/2004 | Senda | 257/292 |
| 2006/0067648 | A1 * | 3/2006 | Chui et al. | 385/147 |
| 2007/0121362 | A1 * | 5/2007 | Jang et al. | 365/94 |
| 2008/0237005 | A1 * | 10/2008 | Honda | 200/181 |

FOREIGN PATENT DOCUMENTS

| | | | |
|---|---|---|---|
| CN | 1755477 | A | 4/2006 |
| KR | 20060110067 | A | 10/2006 |

* cited by examiner

*Primary Examiner* — Lun-Yi Lao
*Assistant Examiner* — Gregory J Tryder
(74) *Attorney, Agent, or Firm* — Kilpatrick Townsend Stockton LLP

(57) ABSTRACT

The invention provides a switch matrix and display matrix of a display device. The display matrix of a display device includes: a switch matrix including M×N MEMS switches, wherein M is the number of rows and N is the number of columns, and MEMS switches in each row are controlled by a corresponding row drive signal to output respective column data signals; and a pixel matrix including M×N pixel units each of which is coupled with a corresponding one of the M×N MEMS switches and displays in response to the column data signal output from the corresponding MEMS switch. The switch matrix can simplify pixel design and reduce layout area of each pixel. Moreover, conventional design needs special process to handle high voltage of source driver. This invention can realize a display device with one common process while source driver uses high voltage process conventionally.

12 Claims, 6 Drawing Sheets

SWITCH MATRIX AND DISPLAY MATRIX OF DISPLAY DEVICE

CROSS REFERENCE TO RELATED APPLICATIONS

The present application claims priority to 200910164858.0 filed Aug. 11, 2009 entitled "SWITCH MATRIX AND DISPLAY MATRIX OF DISPLAY DEVICE", incorporated by reference for all purposes.

FIELD OF THE INVENTION

The present invention relates to the technical field of display, and in particular to a switch matrix and a display matrix of a display device.

BACKGROUND OF THE INVENTION

In the technologies of micro-projection displays, e.g., a transmissive Liquid Crystal Display (LCD), a reflective Digital Light Processor (DLP), a reflective Liquid Crystal On Silicon (LCOS), etc., or in the technologies of flat panel displays, e.g., a liquid crystal display, an Organic Light Emitting Diode (OLED) display, an electrophoresis display, a Plasma Display Panel (PDP), etc., pixel units of a display matrix (or referred to as electro-controlled optical modulation units) are gated row by row or every other row by a row drive signal and performs display in response to a column data signal.

FIG. 1 illustrates a circuit diagram of a display matrix of a liquid crystal display device in the conventional art. The display matrix includes M×N pixel units (M and N are natural numbers), where M is the number of rows and N is the number of columns. Only two rows multiplied by two columns of the pixel units are schematically illustrated in FIG. 1.

As illustrated in FIG. 1, each pixel unit includes a switch element T1, a storage capacitor Cst and a pixel capacitor Clc. The switch element T1 has a gate coupled with a corresponding row line, a source coupled with a corresponding column line, and a drain coupled with the storage capacitor Cst and the pixel capacitor Clc. Specifically, a switch element T1 of a pixel unit p11 has a gate coupled with a row line L1 and a source coupled with a column line R1; a switch element T1 of a pixel unit p12 has a gate coupled with the row line L1 and a source coupled with a column line R2; a switch element T1 of a pixel unit p21 has a gate coupled with a row line L2 and a source coupled with the column line R1; and a switch element T1 of a pixel unit p22 has a gate coupled with the row line L2 and a source coupled with the column line R2.

When the pixel units p11 and p12 are gated by a gate drive signal G1 on the row line, L1, the switch elements T1 of the pixel units p11 and p12 are closed, and column data signals D1 and D2 on the column lines R1 and R2 are applied respectively to the storage capacitors Cst and the pixel capacitors Clc of the pixel units p11 and p12 via the switch elements T1. When the pixel units p21 and p22 are gated by a gate drive signal G2 on the row line L2, the switch elements T1 of the pixel units p21 and p22 are closed, and the column data signals D1 and D2 on the column lines R1 and R2 are applied respectively to the storage capacitors Cst and the pixel capacitors Clc of the pixel units p21 and p22 via the switch elements T1.

When a column data signal is applied to the storage capacitor Cst and the pixel capacitor Clc the storage capacitor Cst is charged to retain the voltage of the column data signal and provides the voltage to the pixel capacitor Clc, liquid crystal molecules LC filled between both electrodes of the pixel capacitor Clc are twisted to an extent which is determined by the voltage of the column data signal, and to an extent which can generate intensity varying light in combination with a backlight source, a polarization piece, etc.

Typically, the switch elements of the pixel units as illustrated in FIG. 1 are transistors, e.g., thin film transistors, field effect transistors, etc., which may have to occupy an indispensable layout area and thus hinder miniaturization and high level of integration of the display device due to process factors of, e.g., a design rule, a Critical Dimension (CD), a layout, etc., resulting from the gates, sources and drains of the transistors, etc.

SUMMARY OF THE INVENTION

An issue to be addressed by the present invention is to provide a switch matrix and a display matrix of a display device for a reduced layout area to achieve miniaturization and high level of integration of the display device.

To address the foregoing issue, an embodiment of the present invention provides a switch matrix of a display device, including M×N Micro Electro Mechanical System (MEMS) switches, where M is the number of rows and N is the number of columns, and MEMS switches in each row are controlled by a corresponding row drive signal to output respective column data signals.

To address the foregoing issue, an embodiment of the present invention further provides a display matrix of a display device, including:

- a switch matrix including M×N MEMS switches, where M is the number of rows and N is the number of columns, and MEMS switches in each row are controlled by a corresponding row drive signal to output respective column data signals; and
- a pixel matrix including M×N pixel units each coupled with a corresponding one of the M×N MEMS switches and each pixel unit displaying in response to the column data signal output from the corresponding MEMS switch.

The foregoing technical solutions in which MEMS switches instead of transistors are used as switch elements have the following advantages compared with the conventional art:

The MEMS switches are structured simply and less susceptible to process factors and therefore occupy a reduced layout area. For a display device with millions or even tens of millions of pixels, the use of the MEMS switches can achieve a significantly reduced layout area of pixel circuits and thus minimization and high level of integration of the display device.

It is easy to merge MEMS switches in the same row and also achieve routing and driving of a row drive signal to thereby further reduce the layout area of the display chip and also facilitate integration into a micro switch matrix device.

A drive circuit for generating a row drive signal and a drive circuit for generating a column data signal may be implemented respectively with a common voltage process and a high voltage process. In other words, the common voltage process can be used to implement the charge and discharge of the storage capacitor which should be implemented by a high voltage conventionally, thereby reducing the power consumption and cost.

A small storage capacitor may be sufficient for a display device with MEMS switches to maintain a pixel voltage required to display a frame of image, thereby improving the display quality and resolution of the display device.

When an MEMS switch is closed, a data signal flows directly from the first terminal to the second terminal to thereby provide more stable charging current.

The integration of MEMS switches can improve the aperture ratio of pixels, and further reduce the size of the pixels, so that the overall chip size can be reduced in the case of the same resolution and thus the production cost can be reduced.

DETAILED DESCRIPTION OF THE INVENTION

A display matrix of a display device according to an embodiment of the present invention uses Micro Electro Mechanical Systems (MEMS) switches instead of transistors as switch elements, and the MEMS switches can be merged together into a switch matrix.

MEMS technologies which are leading technologies in the 21$^{st}$ century built upon micro/nanotechnologies refer to technologies for designing, machining, manufacturing, measuring and controlling micro/nonmaterial. With manufacturing technologies combining micro electro technologies and micro machining technologies, the MEMS technologies can integrate mechanical members, optical systems, driving components and electro control systems into a monolithic micro system. MEMS switches, as one of applications of the MEMS technologies, are mechanical switches manufactured with the process of machining semiconductor silicon.

A switch matrix of a display device according to an embodiment of the present invention includes M×N MEMS switches, where M is the number of rows and N is the number of columns, and MEMS switches in each row are controlled by a corresponding row drive signal to output respective column data signals.

Figure 1:
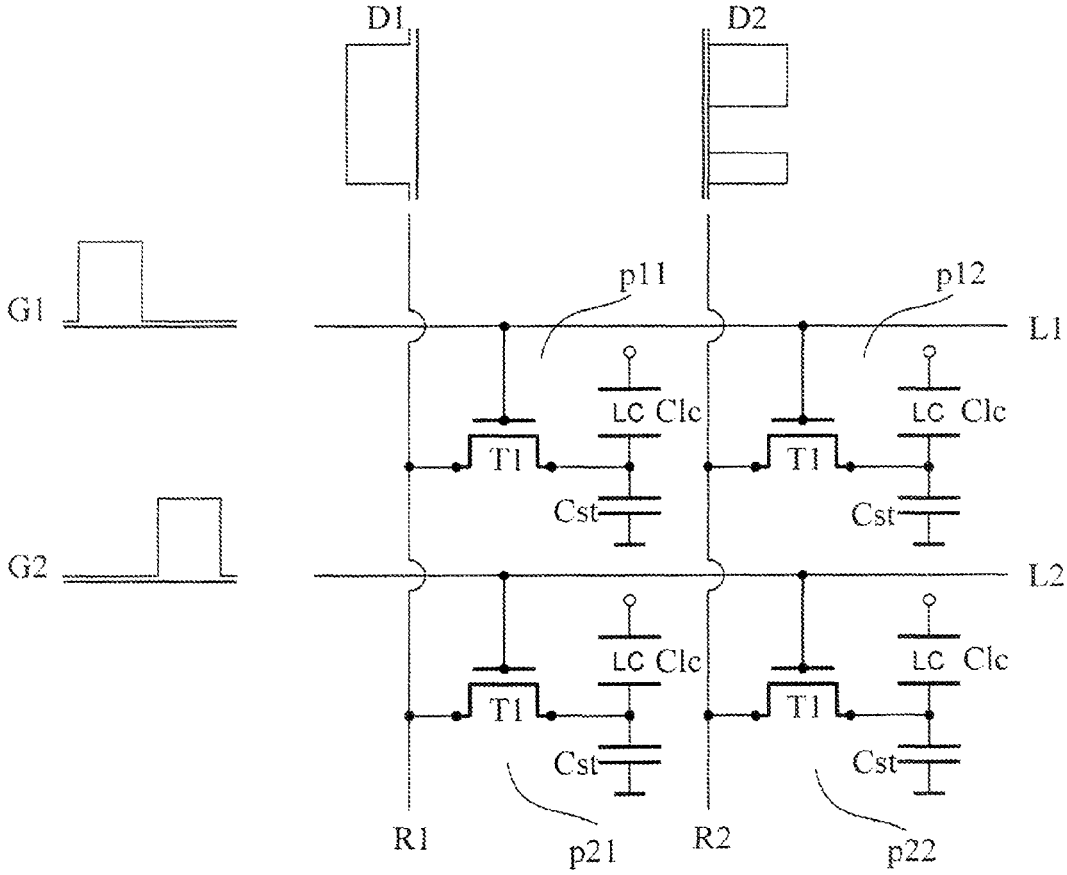
FIG. 1 illustrates a circuit diagram of a display matrix of a liquid crystal display device in the conventional art.
Figure 2:
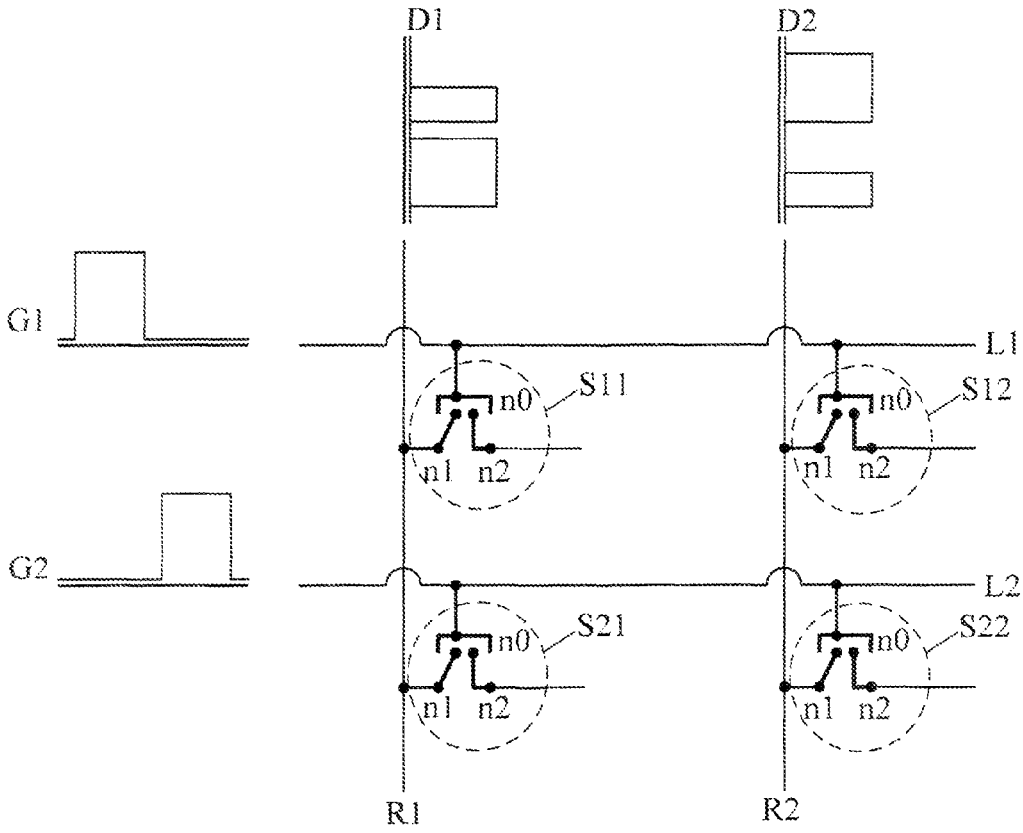
FIG. 2 illustrates a circuit diagram of a switch matrix of a display device according to an embodiment of the present invention.
Figure 3A:
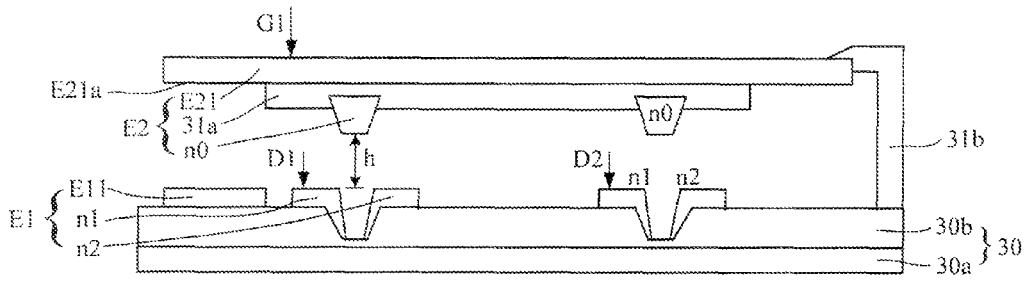
FIG. 3*a* and FIG. 3*b* illustrate side views of the structure of a switch matrix of a display device according to the embodiment of the present invention.
Figure 4:
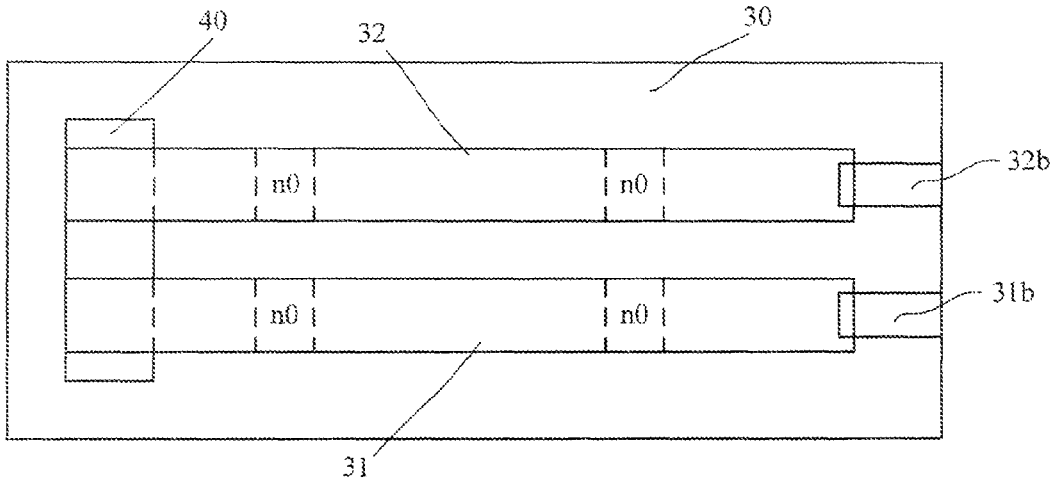
FIG. 4 illustrates a top view of the structure of a switch matrix of a display device according to the embodiment of the present invention.

The present invention is described in detail below with reference to the drawings and an embodiment thereof. FIG. 2 illustrates a circuit diagram of a switch matrix of a display device according to the present embodiment, which schematically illustrates a circuit of MEMS switches of two rows by two columns. FIG. 3*a* illustrates a side view of the structure of the switch matrix of the display device according to the present embodiment, which schematically illustrates the structure of two MEMS switches in the first row as illustrated in FIG. 2. FIG. 4 illustrates a top view of the structure of the switch matrix as illustrated in FIG. 2.

Referring to FIG. 2, FIG. 3*a* and FIG. 4, each MEMS switch in the switch matrix according to the present embodiment includes: a first electrode E1 with a first terminal n1 to which a corresponding column data signal is input and a second terminal n2; and a second electrode E2 with an electrical conductor n0. A corresponding row drive signal controls relative movement of the first electrode E1 and the second electrode E2, so that the electrical conductor n0 of the second electrode E2 connects the first terminal n1 and the second terminal n2 of the first electrode E1.

As illustrated in FIG. 3*a*, the first electrode E1 of each MEMS switch according to the present embodiment is formed on a base 30. The base 30 includes a substrate 30*a* (e.g., silicon substrate) and a first insulation layer 30*b* (e.g., a silicon dioxide insulation layer) on the surface of the substrate 30*a*, the first insulation layer 30*b* has an opening. The first electrode E1 includes a first plate (e.g., an aluminum plate) E11, the first terminal n1 and the second n2, which are mutually insulated. Particularly, the first plate E11 is formed on the first insulation layer 30*b* of the base 30, and the first terminal n1 and the second terminal n2 are formed respectively on respective sides of the opening of the first insulation layer 30*b* of the base 30.

The second electrode E2 arranged facing the first electrode E1 includes a second plate (e.g., an aluminum plate) E21 and the electrical conductor n0, which are mutually insulated. Particularly, the second plate E21 is arranged facing the first plate E11. The second electrode E2 further includes a second insulation layer (e.g., a silicon nitride insulation layer) 31*a* which is formed on the surface of the second plate E21 facing the first plate E11 and exposes the surface E21*a* of the second plate E21 facing the first plate E11. The second insulation layer 31*a* is provided with an opening arranged to correspond to the opening of the first insulation layer 30*b*. The electrical conductor n0 is formed in the opening of the second insulation layer 31*a*, and the second insulation layer 31*a* insulates the second plate E21 from the electrical conductor n0. There is a vertical distance h from the electrical conductor n0 of the second electrode E2 to the first terminal n1 and the second terminal n2 of the first electrode E1, and the electrical conductor n0 does not contact with the first terminal n1 and the second terminal n2 unless the MEMS switch is gated.

A row drive signal G1 is applied to the second plate E21 of the second electrode E2 of the MEMS switch S11 and the second plate E21 of the second electrode E2 of the MEMS switch S12 via a row line L1; and a row drive signal G2 is applied to the second plate E21 of the second electrode E2 of the MEMS switch S21 and the second plate E21 of the second electrode E2 of the MEMS switch S22 via a row line L2. A column data signal D1 is applied to the first terminal n1 of the first electrode E1 of the MEMS switch S11 and the first terminal n1 of the first electrode E1 of the MEMS switch S21 via a column line R1; and a column data signal D2 is applied to the first terminal n1 of the first electrode E1 of the MEMS switch S12 and the first terminal n1 of the first electrode E1 of the MEMS switch S22 via a column line R2.

When the MEMS switches S11 and S12 are gated, the row drive signal G1 is a positive pulse, a voltage difference occurs between the first plate E11 of the first electrode E1 and the second plate E21 of the second electrode E2 of each of the MEMS switches S11 and S12 (the first plate E11 is at a low voltage, and the second electrode E21 is at a high voltage), the first plate E11 and the second plate E21 are attracted electro statically into contact, and the electrical conductor n0 of the second electrode E2 is connected across the first terminal n1 and the second terminal n2 of the first electrode E1 to connect the first terminal n1 and the second terminal n2, so that the column data signal D1 flows from the first terminal n1 to the second terminal n2 of the MEMS switch S11, that is, the column data signal D1 is output from the second terminal n2 of the MEMS switch S11, and the column data signal D2 flows from the first terminal n1 to the second terminal n2 of the MEMS switch S12, that is, the column data signal D2 is output from the second terminal n2 of the MEMS switch S12.

When the MEMS switches S21 and S22 are gated, the row drive signal G2 is a positive pulse, a voltage difference occurs between the first plate E11 of the first electrode E1 and the second plate E21 of the second electrode E2 of each of the MEMS switches S21 and S22 (the first plate E11 is at a low voltage, and the second electrode E21 is at a high voltage), the first plate E11 and the second plate E21 are attracted electrostatically into contact, and the electrical conductor n0 of the second electrode E2 is connected across the first terminal n1 and the second terminal n2 of the first electrode E1 to connect first terminal n1 and the second terminal n2, so that the column data signal D1 flows from the first terminal n1 to the second terminal n2 of the MEMS switch S21, that is, the column data signal D1 is output from the second terminal n2 of the MEMS switch S21, and the column data signal D2 flows from the first terminal n1 to the second terminal n2 of the MEMS switch S22, that is, the column data signal D2 is output from the second terminal n2 of the MEMS switch S22.

When no MEMS switch is gated, there is no voltage difference between the first plate E11 of the first electrode E1 and the second plate E21 of the second electrode E2 of any MEMS switch (both the first plate E11 and the second plate E21 are at a low voltage), the first plate E11 is separated from the second plate E21 due to a restoration force, and the first plate E11 is not connected with the second plate E21.

The first electrodes E1 of the MEMS switches of the switch matrix may be formed on the same base, and the first plates E11 of the first electrodes E1 may form the same plate. Because MEMS switches in the same row are gated simultaneously, the second plates E21 of the second electrodes E2 of MEMS switches in the same row may form the same plate, and the second plates E21 of the second electrodes E2 of MEMS switches in different rows may form different plates. Referring to FIG. 2, FIG. 3*a* and FIG. 4, the first electrodes E1 of the MEMS switches S11, S12, S21 and S22 are formed on the same base 30, and the first plates of the first electrodes E1 form the same plate 40, the second plates of the second electrodes E2 of the MEMS switches S11 and S12 form the same plate 31, and the second plates of the second electrodes E2 of the MEMS switches S21 and S22 form the same plate 32.

In the present embodiment, the plate 31 is connected to the base 30 through a support body 31*b*, and the plate 32 is connected to the base 30 through a support body 32*b*, so that the plates 31 and 32 can move relative to the base 30. When the MEMS switches S11 and S12 are gated by the row drive signal G1, the plate 31 moves toward the base 30, that is, the second electrodes E2 move towards the first electrodes E1 of the MEMS switches S11 and S12, so that the electrical conductors n0 of the second electrodes E2 connect the first terminals n1 and the second terminals n2 of the first electrode E1. When neither MEMS switch S11 nor S12 is gated, the plate 31 departs from the base 30. When the MEMS switches S21 and S22 are gated by the row drive signal G2, the plate 32 moves toward the base 30, that is, the second electrodes E2 move towards the first electrodes E1 of the MEMS switches S21 and S22, so that the electrical conductors n0 of the second electrodes E2 connect the first terminals n1 and the second terminals n2 of the first electrode E1. When neither MEMS switch S21 nor S22 is gated, the plate 32 departs from the base 30.

Those skilled in the art can appreciate that the structure of the switch matrix will not be limited to that described in the foregoing embodiment but numerous variations of structures and connections are possible, for example:

In another embodiment, each MEMS switch may be structured as including: a first electrode with an electrical conductor, and a second electrode with a first terminal to which a column data signal is input and a second terminal, where the row drive signal controls relative movement of the first electrode and the second electrode, so that the electrical conductor of the first electrode connects the first terminal and the second terminal of the second electrode.

In the present embodiment, the second plates of the second electrodes of MEMS switches in the same row form the same plate, and the second plates of the second electrodes of MEMS switches in different rows form different plates. In another embodiment, the second plates of the second electrodes of a predetermine column number of MEMS switches in the same row form the same plate in order for a reasonable layout of column lines, for example, the second plates of the second electrodes of the $1^{st}$ to $10^{th}$ MEMS switches in the same row form the same plate, the second plates of the second electrodes of the $11^{th}$ to $20^{th}$ MEMS switches in the same row form the same plate, . . . . Alternatively, the first plates of the first electrodes of MEMS switches in the same row form the same plate, and the first plates of the first electrodes of MEMS switches in different rows form different plates; or the first plates of the first electrodes of the respective MEMS switches are different plates respectively, and the second plates of the second electrodes are different plates respectively.

In the present embodiment, the row drive signal with a positive pulse is applied to the second plate of the second electrode while applying a low voltage to the first plates of the first electrode. In another embodiment, each MEMS switch can be gated otherwise so that a voltage difference occurs between the first plate of the first electrode and the second plate of the second electrode of the gated MEMS switch. For example, the row drive signal with a negative pulse is applied to the second plate of the second electrode while applying a high voltage to the first plate of the first electrode. In another example, when the first plates of the first electrodes of MEMS switches in the same row form the same plate, and the first plates of the first electrodes of MEMS switches in different rows form different plates, a row drive signal with a positive pulse can be applied to the first plates of the first electrodes while applying a low voltage to the second plates of the second electrodes; or a row drive signal with a negative pulse can be applied to the first plates of the first electrodes while applying a high voltage to the second plates of the second electrodes.

Figure 3B:
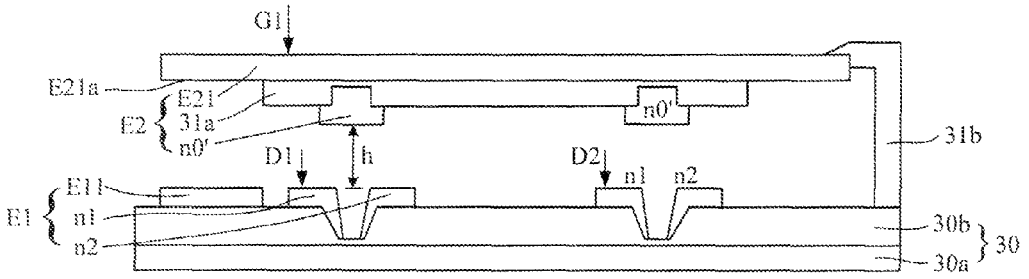

Moreover, the structure of the electrical conductor is not limited to the structure of the upside-down trapezoid bump filled in the opening of the second insulation layer as illustrated in the present embodiment but may be another structure provided that the electrical conductor can connect the first terminal and the second terminal due to relative movement of the first terminal and the second terminal. As illustrated in FIG. 3, for example, the electrical conductor n0' of the second electrode E2 connects across between the first terminal n1 and the second terminal n2 of the first electrode E1 upon movement of the second electrode E2 relative to the first electrode E1.

A display matrix of a display device according to an embodiment of the present invention includes a switch matrix and a pixel matrix.

The switch matrix includes M×N MEMS switches, where M is the number of rows and N is the number of columns, and MEMS switches in each row are controlled by a corresponding row drive signal to output respective column data signals.

The pixel matrix includes M×N pixel units each coupled with a corresponding one of the M×N MEMS switches. Each pixel unit displays in response to the column data signal output from a corresponding MEMS switch.

The MEMS switches are coupled with the respective pixel units. Illumination sources of the pixel units may be liquid crystal molecule, rotatable micro mirrors, coherent micro mirrors, organic light emitting diodes, electrophoresis granules, electric arc tubes, etc.

Figure 5:
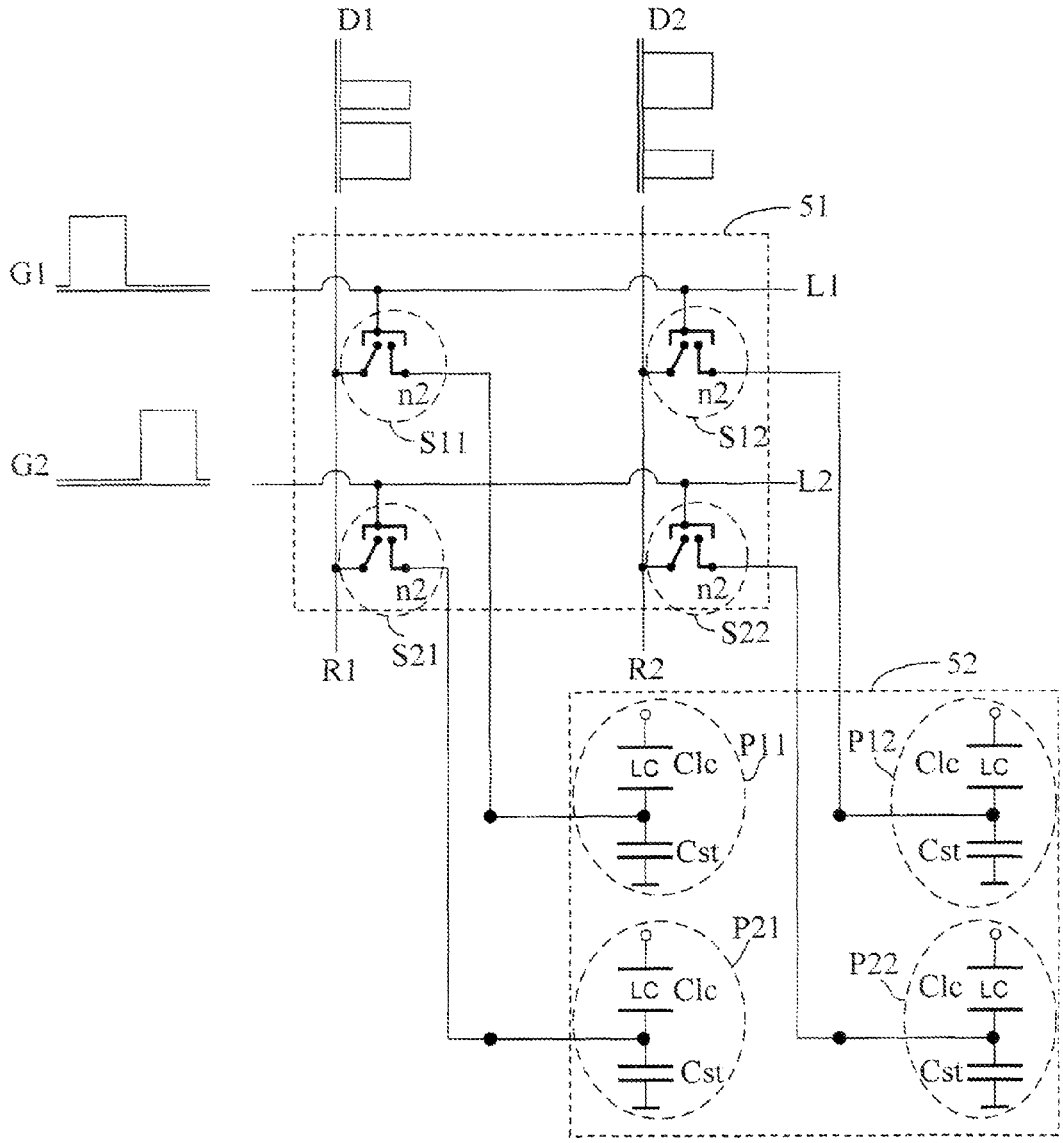
FIG. 5 is a circuit diagram of a display matrix of a display device according to an embodiment of the present invention.

FIG. 5 is a circuit diagram of a display matrix of a display device according to an embodiment of the present invention, which schematically illustrates a circuit of MEMS switches and pixel units of two rows by two columns. The display device in the present embodiment is a transmissive liquid crystal projection display device.

Respective MEMS switches in a switch matrix 51 are structured and connected as described above, and repeated descriptions thereof are omitted here.

Each pixel unit in a pixel matrix 52 includes a pixel capacitor Clc and a storage capacitor Cst coupled with the pixel capacitor Clc, and a column data signal output from a corresponding MEMS switch is applied to the node where the pixel capacitor Clc and the storage capacitor Cst are coupled. Liquid crystal molecules are filled between both electrodes of the pixel capacitor Clc.

Specifically, the pixel capacitor Clc of a pixel unit P11 has one electrode coupled with a common electrode and the other electrode coupled with one electrode of the storage capacitor Cst and the second terminal n2 of the MEMS switch S11, and the other electrode of the storage capacitor Cst is coupled with a low voltage. The pixel capacitor Clc of a pixel unit P12 has one electrode coupled with the common electrode and the other electrode coupled with one electrode of the storage capacitor Cst and the second terminal n2 of the MEMS switch S12, and the other electrode of the storage capacitor Cst is coupled with the low voltage. The pixel capacitor Clc of a pixel unit P21 has one electrode coupled with the common electrode and the other electrode coupled with one electrode of the storage capacitor Cst and the second terminal n2 of the MEMS switch S21, and the other electrode of the storage capacitor Cst is coupled with the low voltage. The pixel capacitor Clc of a pixel unit P22 has one electrode coupled with the common electrode and the other electrode coupled with one electrode of the storage capacitor Cst and the second terminal n2 of the MEMS switch S22, and the other electrode of the storage capacitor Cst is coupled with the low voltage.

When the MEMS switches S11 and S12 are gated by the gate drive signal G1 on the row line L1, the column data signals D1 and D2 on the column lines R1 and R2 are applied respectively to the storage capacitors Cst and the pixel capacitors Clc of the pixel units P11 and P12 via the MEMS switches S11, and S12. When the MEMS switches S21 and S22 are gated by the gate drive signal G2 on the row line L2, the column data signals D1 and D2 on the column lines R1 and R2 are applied respectively to the storage capacitors Cst and the pixel capacitors Clc of the pixel units P21 and P22 via the MEMS switches S21 and S22.

Each pixel unit displays in response to the voltage of the column data signal output from the corresponding MEMS switch. When the column data signal output from the MEMS switch is applied to the storage capacitor Cst and the pixel capacitor Clc of the pixel unit, the storage capacitor Cst is charged to retain the voltage of the column data signal and supply the voltage to the pixel capacitor Clc, liquid crystal molecules LC filled between both electrodes of the pixel capacitor Clc are twisted to an extent which is determined by the voltage of the column data signal, and the varying extent to which the liquid crystal molecules are twisted results in a varying dichroic light path difference, which can generate intensity varying light in combination with a backlight source, a polarization piece, etc.

In another embodiment, the display device may be another projection display device with a structure similarly to the transmissive liquid crystal display device, e.g., a reflective digital light processor display device, a reflective liquid crystal on silicon display device, etc., or a flat panel display device, e.g., a liquid crystal display device, an Organic Light Emitting Diode (OLED) display device, an electrophoresis display device, a plasma display device, etc. Pixel units of a display matrix are gated row by row or every other row by a row drive signal and display in response to a column data signal.

Figure 6:
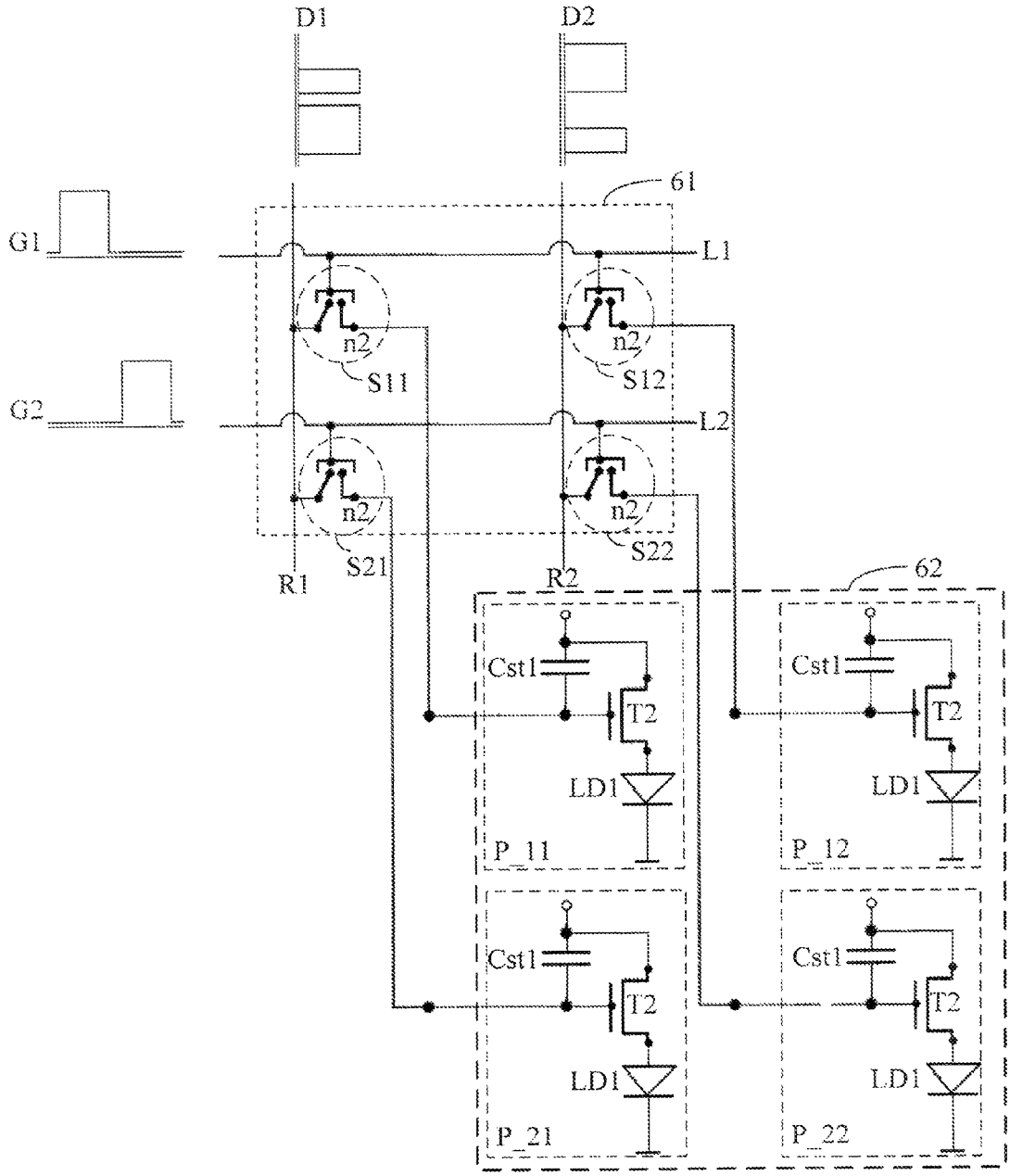
FIG. 6 is a circuit diagram of a display matrix of a display device according to another embodiment of the present invention.

FIG. 6 illustrates a circuit diagram of a display matrix of a display device according to another embodiment of the present invention, which schematically illustrates a circuit of MEMS switches and pixel units of two rows by two columns. The display device in the present embodiment is an organic light emitting diode display device. The switch matrix 61 is structured identically to the switch matrix 51 of the liquid crystal display device as illustrated in FIG. 5. Pixel units in the pixel matrix 62 are structured differently from the pixel units in the pixel matrix 52 of the liquid crystal display device as illustrated in FIG. 5.

As illustrated in FIG. 6, each pixel unit includes: a drive transistor T2, an organic light emitting diode LD1 and a storage capacitor Cst1. The drive transistor T2 has a gate coupled with the storage capacitor Cst1, and a drain coupled with the organic light emitting diode LD1. The column data signal output from the corresponding MEMS switch is applied to the where the gate of the drive transistor T2 and the storage capacitor Cst1 are coupled.

Specifically, the drive transistor T2 of each pixel unit has a gate coupled with one electrode of the storage capacitor Cst1, a source coupled with the other electrode of the storage capacitor Cst1 and with a high voltage, and a drain coupled with one terminal of the organic light emitting diode LD1, and the other terminal of the organic light emitting diode LD1 is coupled with a low voltage. The drive transistor T2 of a pixel unit P_11 has a gate coupled with the second terminal n2 of the MEMS switch S11, the drive transistor T2 of a pixel unit P_12 has a gate coupled with the second terminal n2 of the MEMS switch S12, the drive transistor T2 of a pixel unit P_21 has a gate coupled with the second terminal n2 of the MEMS switch S21, and the drive transistor T2 of a pixel unit P_22 has a gate coupled with the second terminal n2 of the MEMS switch S22.

Each pixel unit displays in response to the voltage of the column data signal output from the corresponding MEMS switch. When the column data signal output from the MEMS switch is applied to the storage capacitor Cst1 and the gate of the drive transistor T2 of the pixel unit, the storage capacitor Cst1 is charged to retain the voltage of the column data signal and supply the voltage to the drive transistor T2. The drive transistor T2 is drived by the voltage of the storage capacitor Cst1 to supply drive current to the organic light emitting diode LD1. The organic light emitting diode LD1 receives the drive current and emits light, the intensity of which is determined by the magnitude of the drive current.

In summary, the foregoing technical solutions in which MEMS switches are used as switch elements have the following advantages compared with the conventional art in which transistors are used switch elements:

The transistors have to occupy an indispensable layout area due to process factors of, e.g., a design rule, a critical dimension, a layout, etc., resulting from the gates, sources and drains thereof, etc. However, the MEMS switches, as super micro mechanical switches which make use of contact of an electrical conductor for signal transmission, are structured simply and less susceptible to the process factors and therefore occupy a reduced layout area. For a display device with millions or even tens of millions of pixels, the use of the MEMS switches can achieve a significantly reduced layout area of a display chip and thus minimization and high level of integration of the display device.

Since pixel units in the same row are gated simultaneously, that is, switch elements in the same row are closed or opened simultaneously, and the MEMS switches occupy a small layout area, it is easy to merge MEMS switches in the same row and also achieve routing and driving of a row drive signal to thereby further reduce the layout area of the display chip. Moreover, the transistors occupy a large layout area, and the MEMS switches occupy a small layout area to facilitate integration in a micro switch matrix device.

During operation of a transistor, both the source and the gate are supplied with the same high voltage. Because a high voltage (e.g., +15V) should be used to drive a liquid crystal display, that is, to charge and discharge a storage capacitor, both a drive circuit for generating a row drive signal and a drive circuit for generating a column data signal have to be implemented with a high voltage process. However, a drive signal at a reduced high voltage (e.g. +5V) is sufficient for an MEMS switch to generate a voltage difference for gating the input terminal and output terminal. Therefore, a drive circuit for generating a row drive signal and a drive circuit for generating a column data signal may be implemented respectively with a common voltage process and a high voltage process. In other words, the common voltage process can be used to implement the charge and discharge of the storage capacitor which should be implemented by a high voltage conventionally, thereby reducing the power consumption and cost.

Leakage current is present in a disabled transistor, and the storage capacitor has to supply a leakage voltage to the transistor in addition to supplying a voltage to the pixel capacitor. When the electrical conductor has no contact with the first terminal and the second terminal, no leakage current is present in an MEMS switch, and the storage capacitor only needs to supply a voltage to the pixel capacitor. Therefore, a small storage capacitor is sufficient for a display device with MEMS switches to maintain a pixel voltage required to display a frame of image. The small storage capacitor can be charged and discharged at a higher speed, and the absence of any other leakage path can enable the pixel capacitor to be supplied rapidly with a predetermined pixel voltage to make liquid crystal molecules emit light so as to improve the display quality of the display device. Moreover, the small storage capacitors occupy a reduced layout area, and thus more pixel units can be arranged in the same layout area of a display region to thereby improve the display resolution of the display device.

When a transistor operating in a saturation region is conductive, a data signal flows from the source to the drain, the voltage at the drain of the transistor gradually increases as the storage capacitor is charged, the source-drain voltage and the source-drain current of the transistor gradually decreases, that is, charging current supplied by the transistor to the storage capacitor gradually decreases. When an MEMS switch is closed, a data signal flows directly from the first terminal to the second terminal, that is, charging current supplied from the second terminal of the MEMS switch to the storage capacitor is not influenced by any transistor. Therefore, the use of MEMS switches can provide more stable charging current.

The integration of MEMS switches can improve the aperture ratio of pixels and the quality of an image, and further reduce the size of the pixels, so that the overall chip size can be reduced in the case of the same resolution and thus the production cost can be reduced.

Although the present invention has been disclosed as above in connection with the preferred embodiments thereof, but the present invention will not be limited thereto. Any skilled in the art can make various modifications and variations without departing from the spirit and scope of the present invention. The scope of the present invention is defined in the appended claims.

What is claimed is:

1. A switch matrix of a display device, comprising M*N MEMS switches, wherein M is the number of rows and N is the number of columns, and MEMS switches in each row are controlled by a corresponding row drive signal to output respective column data signals, wherein each of the MEMS switches comprises:

a first electrode comprising a first terminal to which a column data signal is input and a second terminal, and a first plate insulated from the first terminal and the second terminal; and a second electrode comprising an electrical conductor and a second plate insulated from the electrical conductor, wherein the row drive signal controls relative movement of the first electrode and the second electrode so that the electrical conductor of the second electrode connects the first terminal and the second terminal of the first electrode, wherein the first electrode is formed on a base which comprises a substrate and a first insulation layer arranged on a surface of the substrate, the first insulation layer having an opening, and the first plate of the first electrode is formed on the interface of the first insulation layer of the base, and the first terminal and the second terminal are formed respectively on sides of the opening of the first insulation layer of the base, and wherein the second plate of the second electrode is arranged facing the first plate of the first electrode; the second electrode further comprises a second insulation layer which is formed on the surface of the second plate facing the first plate and exposes the surface of the second plate facing the first plate; the second insulation layer is provided with an opening arranged to correspond to the opening of the first insulation layer; and the electrical conductor is formed in the opening of the second insulation layer.

2. The switch matrix of a display device according to claim 1, wherein the first plates of the first electrodes of the M*N MEMS switches form one plate.

3. The switch matrix of a display device according to claim 1, wherein the second plates of the second electrodes of MEMS switches in the same row form one plate.

4. The switch matrix of a display device according to claim 1, wherein the second plates of the second electrodes of a predetermined number of columns of MEMS switches in the same row form one plate.

5. The switch matrix of a display device according to claim 1, wherein the row drive signal is applied to the second plate of the second electrode.

6. The switch matrix of a display device according to claim 1, wherein the row drive signal is a positive pulse signal.

7. The switch matrix of a display device according to claim 1, wherein the row drive signal is a negative pulse signal.

8. The switch matrix of a display device according to claim 1, wherein the second electrode is connected to the base through a support body.

9. A display matrix of a display device, comprising:

a switch matrix comprising M*N MEMS switches, wherein M is the number of rows and N is the number of columns, and MEMS switches in each row are controlled by a corresponding row drive signal to output respective column data signals, wherein each of the MEMS switches comprises:

a first electrode comprising a first terminal to which a column data signal is input and a second terminal, and a first plate insulated from the first terminal and the second terminal; and a second electrode comprising an electrical conductor and a second plate insulated from the electrical conductor, wherein the row drive signal controls relative movement of the first electrode and the second electrode, so that the electrical conductor of the second electrode connects the first terminal and the second terminal of the first electrode, wherein the first electrode is formed on a base which comprises a substrate and a first insulation layer arranged on a surface of the substrate, the first insulation layer having an opening, and the first plate of the first electrode is formed on the interface of the first insulation layer of the base, and the first terminal and the second terminal are formed respectively on sides of the opening of the first insulation layer of the base, and wherein the second electrode is arranged facing the first plate of the first electrode; the second electrode further comprises a second insulation layer which is formed on the surface of the second slate facing the first plate and exposes the surface of the second plate facing the first plate; the second insulation layer is provided with an opening arranged to correspond to the opening of the first insulation layer; and the electrical conductor is formed in the opening of the second insulation layer; and a pixel matrix, comprising M*N pixel units each coupled with a corresponding one of the M*N MEMS switches, each pixel unit displaying in response to the column data signal output from the corresponding MEMS switch.

10. The display matrix of a display device according to claim 9, wherein the display device is a projection display device or a flat panel display device.

11. The display matrix of a display device according to claim 9, wherein each of the pixel units comprises a pixel, capacitor and a storage capacitor coupled with the pixel capacitor, and the column data signal is applied to the node where the pixel capacitor and the storage capacitor are coupled.

12. The display matrix of a display device according to claim 9, wherein each of the pixel units comprises a drive transistor, an organic light emitting diode and a storage capacitor, the drive transistor has a gate coupled with the storage capacitor, and a drain coupled with the organic light emitting diode, and the column data signal is applied to the node where the gate of the drive transistor and the storage capacitor are coupled.

* * * * *

UNITED STATES PATENT AND TRADEMARK OFFICE

CERTIFICATE OF CORRECTION

PATENT NO. : 8,482,497 B2
APPLICATION NO. : 12/815118
DATED : July 9, 2013
INVENTOR(S) : Lei Zhang et al.

It is certified that error appears in the above-identified patent and that said Letters Patent is hereby corrected as shown below:

In the Specification:
Column 8, line 33, the word node has been omitted. Please insert --node-- after the phrase applied to the.

In the Claims:
In Claim 9, Column 12, line 1, please insert --plate of the second-- after the phrase wherein the second.

In Claim 9, Column 12, line 4, please delete “slate” and insert --plate--.

Signed and Sealed this
Twenty-seventh Day of August, 2013

Teresa Stanek Rea
*Acting Director of the United States Patent and Trademark Office*